US008754723B2

(12) United States Patent
Masuda et al.

(10) Patent No.: US 8,754,723 B2
(45) Date of Patent: Jun. 17, 2014

(54) ELECTRONIC COMPONENT INCLUDING DIRECTIONAL COUPLER

(75) Inventors: Hiroshi Masuda, Nagaokakyo (JP); Takahiro Mori, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 351 days.

(21) Appl. No.: 13/211,355

(22) Filed: Aug. 17, 2011

(65) Prior Publication Data

US 2012/0049974 A1 Mar. 1, 2012

(30) Foreign Application Priority Data

Aug. 25, 2010 (JP) ..... 2010-188363

(51) Int. Cl.
*H01P 5/18* (2006.01)
*H01P 3/08* (2006.01)

(52) U.S. Cl.
USPC ..... 333/116; 333/238

(58) Field of Classification Search
USPC ..... 333/109–116, 238
See application file for complete search history.

(56) References Cited

U.S. PATENT DOCUMENTS 5,742,210 A * 4/1998 Chaturvedi et al. ..... 333/116
6,819,202 B2 * 11/2004 Ralph ..... 333/125
2007/0184251 A1 8/2007 Chikagawa

FOREIGN PATENT DOCUMENTS

CN 101049058 A 10/2007
JP 2005-012559 A 1/2005

* cited by examiner

*Primary Examiner* — Robert Pascal
*Assistant Examiner* — Kimberly Glenn
(74) *Attorney, Agent, or Firm* — Keating & Bennett, LLP

(57) ABSTRACT

External electrodes are provided on a bottom surface of a laminate, and are connected to both ends of a main line and both ends of a sub-line, respectively. A warpage prevention conductor is provided on an insulating material layer that is provided on a top surface side of the laminate with respect to insulating material layers to which the main line is provided and with respect to insulating material layers to which the sub-line is provided. The warpage prevention conductor overlaps with the external electrodes when seen from a z-axis direction in a plan view. A conductor layer that is not connected to the main line or the sub-line is not provided on any of the insulating material layers provided on a bottom surface side of the laminate with respect to the insulating material layer on which the warpage prevention conductor is provided.

5 Claims, 3 Drawing Sheets

ELECTRONIC COMPONENT INCLUDING DIRECTIONAL COUPLER

BACKGROUND OF THE INVENTION

1. Field of the Invention

The present invention relates to an electronic component, and more specifically, relates to an electronic component including a directional coupler.

2. Description of the Related Art

As an existing electronic component, for example, a coupler disclosed in Japanese Unexamined Patent Application Publication No. 2005-12559 is known. Hereinafter, the coupler disclosed in Japanese Unexamined Patent Application Publication No. 2005-12559 will be described with reference to the drawing. FIG. 3 is a perspective view of a coupler 500 disclosed in Japanese Unexamined Patent Application Publication No. 2005-12559.

The coupler 500 includes a dielectric substrate 502, a first conductor line 504, a second conductor line 506, via-hole conductors B1 to B4, first to fourth terminals 508-514.

The dielectric substrate 502 is composed of a plurality of substantially rectangular dielectric layers laminated to each other. The first conductor line 504 and the second conductor line 506 are line-shaped conductors provided on the dielectric layers, and are electromagnetically coupled to each other. The first terminal 508 and the fourth terminal 514 are external electrodes provided on the bottom surface of the dielectric substrate 502. The via-hole conductors B1 to B4 extend through the dielectric layers in the lamination direction. The via-hole conductors B1 and B2 connect both ends of the first conductor line 504 to the first terminal 508 and a second terminal 510, respectively. The via-hole conductors B3 and B4 connect both ends of the second conductor line 506 to a third terminal 512 and the fourth terminal 514, respectively.

In the coupler 500 disclosed in Japanese Unexamined Patent Application Publication No. 2005-12559, the element can be reduced in size as described below. In a general coupler, a first terminal and a fourth terminal are provided on side surfaces of a dielectric substrate. In this case, drawing conductors for electrically connecting both ends of a first conductor line to the first terminal and a second terminal, and drawing conductors for electrically connecting both ends of a second conductor line to a third terminal and the fourth terminal are needed. The drawing conductors extend from the both ends of the first conductor line and the both ends of the second conductor line toward the outer edges of dielectric layers. Thus, in order to ensure, on the dielectric layers, regions for providing the drawing conductors, the dielectric layers need to be increased in size. As a result, the coupler is increased in size.

Meanwhile, in the coupler 500 disclosed in Japanese Unexamined Patent Application Publication No. 2005-12559, both ends of the first conductor line 504 are connected to the first terminal 508 and the second terminal 510 through the via-hole conductors B1 and B2. Similarly, both ends of the second conductor line 506 are connected to the third terminal 512 and the fourth terminal 514 through the via-hole conductors B3 and B4. The via-hole conductors B1 to B4 extend in the lamination direction. Thus, in the coupler 500, regions for providing the via-hole conductors B1 to B4 do not need to be ensured on the dielectric layers. As a result, in the coupler 500 disclosed in Japanese Unexamined Patent Application Publication No. 2005-12559, the element can be reduced in size.

However, in the coupler 500 disclosed in Japanese Unexamined Patent Application Publication No. 2005-12559, warpage occurs in the dielectric substrate 502 as described below. More specifically, when firing the dielectric substrate 502, the dielectric layers, the first terminal 508, and the fourth terminal 514 contract in different contraction ratios. In addition, the first terminal 508 and the fourth terminal 514 are provided on the bottom surface of the dielectric substrate 502, and no terminal is provided on the top surface of the dielectric substrate 502. Since the first terminal 508 and the fourth terminal 514 are provided only on the bottom surface of the dielectric substrate 502, the dielectric substrate 502 has different contraction ratios in the top surface and the bottom surface. As a result, warpage occurs in the dielectric substrate

SUMMARY OF THE INVENTION

Accordingly, preferred embodiments of the present invention provide an electronic component that prevents occurrence of warpage in a laminate.

According to preferred embodiments of the present invention, an electronic component includes a laminate including a plurality of laminated insulating material layers; a main line provided within the laminate; a sub-line provided within the laminate and electromagnetically coupled to the main line to provide a directional coupler; first and second external electrodes provided on a bottom surface of the laminate and connected to both ends of the main line, respectively; third and fourth external electrodes provided on the bottom surface of the laminate and connected to both ends of the sub-line, respectively; and a warpage prevention conductor provided on the insulating material layer that is located on a top surface side of the laminate with respect to the insulating material layer to which the main line is provided and with respect to the insulating material layer to which the sub-line is provided, the warpage prevention conductor overlapping with the first to fourth external electrodes when seen from a lamination direction in a plan view. A conductor layer that is not connected to either of the main line and the sub-line is not provided on the insulating material layer provided on a bottom surface side of the laminate with respect to the insulating material layer on which the warpage prevention conductor is provided.

According to various preferred embodiments of the present invention, occurrence of warpage in the laminate can be reliably and effectively prevented.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, an electronic component according to a preferred embodiment of the present invention will be described.

Figure 1:
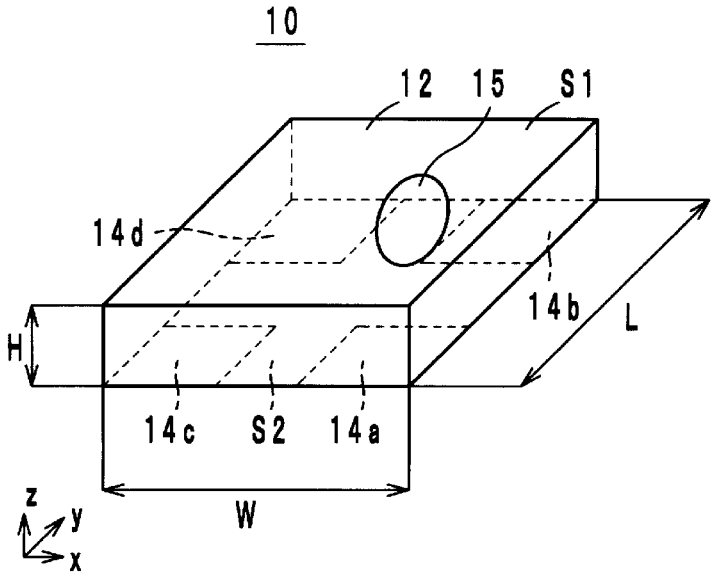
FIG. 1 is a perspective view of an electronic component according to a preferred embodiment of the present invention.
Figure 2:
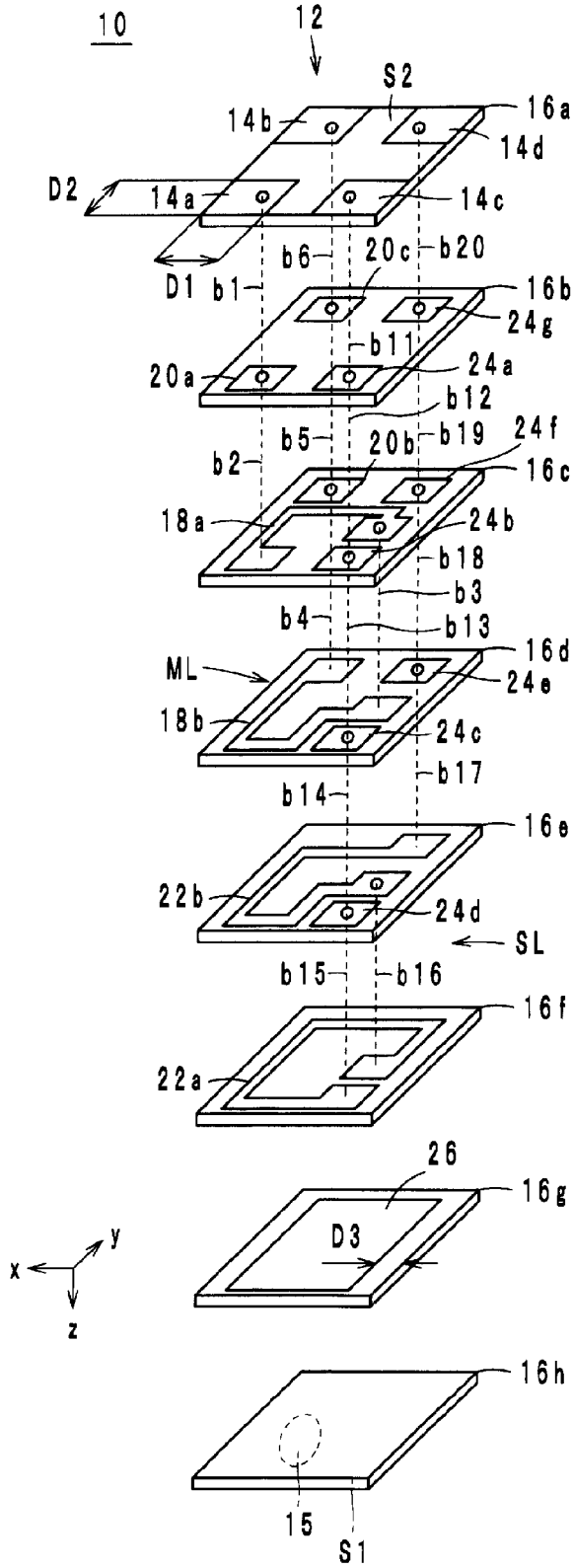
FIG. 2 is an exploded perspective view of the electronic component according to a preferred embodiment of the present invention.
Figure 3:
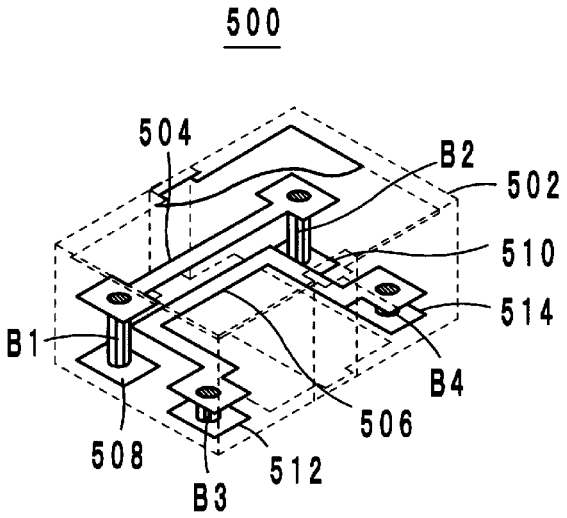
FIG. 3 PRIOR ART
FIG. 3 is a perspective view of a coupler disclosed in Japanese Unexamined Patent Application Publication No. 2005-12559.

Hereinafter, the configuration of the electronic component according to the present preferred embodiment of the present invention will be described with reference to the drawings. FIG. 1 is a perspective view of an electronic component 10 according to the present preferred embodiment. FIG. 2 is an exploded perspective view of the electronic component 10 according to the present preferred embodiment. Hereinafter, a lamination direction of the electronic component 10 is defined as a z-axis direction, and when the electronic component 10 is seen from the z-axis direction in a plan view, a direction along short sides of the electronic component 10 is defined as an x-axis direction, and a direction along long sides of the electronic component 10 is defined as a y-axis direction. The x-axis, the y-axis, and the z-axis are mutually orthogonal to each other. In FIG. 2, the electronic component 10 is shown in a state where the z-axis direction is inverted.

As shown in FIGS. 1 and 2, the electronic component 10 preferably includes a laminate 12, external electrodes 14 (14*a* to 14*d*), a direction identification mark 15, a warpage prevention conductor 26 (see FIG. 2), a main line ML (see FIG. 2), and a sub-line SL (see FIG. 2).

As shown in FIG. 1, the laminate 12 preferably has a substantially rectangular parallelepiped shape, for example. In the laminate 12, the surfaces located on the positive and negative direction sides in the z-axis direction are referred to as top surface S1 and bottom surface S2, respectively. Here, the bottom surface S2 is a mounted surface. In other words, when the electronic component 10 is mounted to a circuit board, the bottom surface S2 faces the circuit board.

As shown in FIG. 2, the laminate 12 includes insulating material layers 16 (16*a* to 16*h*) laminated in order from the negative direction side to the positive direction side in the z-axis direction. Each insulating material layer preferably is substantially rectangular and is made of a dielectric material, for example. Hereinafter, the surface of each insulating material layer 16 on the negative direction side in the z-axis direction is referred to as a front surface, and the surface of each insulating material layer 16 on the positive direction side in the z-axis direction is referred to as a back surface.

As shown in FIGS. 1 and 2, the direction identification mark 15 preferably is a substantially circular conductor provided on the top surface S1 of the laminate 12 (i.e., on the back surface of the insulating material layer 16*h*). The direction identification mark 15 is used to identify the orientation of the electronic component 10 when the electronic component 10 is mounted to a circuit board.

Each external electrode 14 is preferably made of a conductive material, is provided on the bottom surface S2 of the laminate 12 (i.e., on the front surface of the insulating material layer 16*a*), and is substantially rectangular, as shown in FIGS. 1 and 2. The external electrode 14*a* is provided on the bottom surface S2 and at the corner that is located on the positive direction side in the x-axis direction and on the negative direction side in the y-axis direction. The external electrode 14*b* is provided on the bottom surface S2 and at the corner that is located on the positive direction side in the x-axis direction and on the positive direction side in the y-axis direction. The external electrode 14*c* is provided on the bottom surface S2 and at the corner that is located on the negative direction side in the x-axis direction and on the negative direction side in the y-axis direction. The external electrode 14*d* is provided on the bottom surface S2 and at the corner that is located on the negative direction side in the x-axis direction and on the positive direction side in the y-axis direction. It should be noted that each external electrode 14 does not protrude from the bottom surface S2 and is not provided on any side surface of the laminate 12.

The main line ML is provided within the laminate 12, and is connected between the external electrodes 14*a* and 14*b* as shown in FIG. 2. In other words, both ends of the main line ML are connected to the external electrodes 14*a* and 14*b*, respectively. As shown in FIG. 2, the main line ML preferably includes line conductors 18 (18*a* and 18*b*), connection conductors 20 (20*a* to 20*c*), and via-hole conductors b1 to b6.

The line conductors 18*a* and 18*b* preferably are made of a conductive material, are provided on the front surfaces of the insulating material layers 16*c* and 16*d*, respectively, and are wound clockwise when seen from the negative direction side in the z-axis direction in a plan view. Hereinafter, when the line conductors 18*a* and 18*b* are seen from the negative direction side in the z-axis direction in a plan view, the ends of the line conductors 18*a* and 18*b* on the upstream side in the clockwise direction are referred to as upstream ends, and the ends on the downstream side in the clockwise direction are referred to as downstream ends.

The via-hole conductors b1 and b2 preferably are made of a conductive material, extend through the insulating material layers 16*a* and 16*b*, respectively, in the z-axis direction, and are connected to each other to define one via-hole conductor, as shown in FIG. 2. The end of the via-hole conductor b1 on the negative direction side in the z-axis direction is connected to the external electrode 14*a*. In other words, the via-hole conductor b1 defines an end portion of the main line ML. The end of the via-hole conductor b2 on the positive direction side in the z-axis direction is connected to the upstream end of the line conductor 18*a*.

The via-hole conductor b3 preferably is made of a conductive material, and extends through the insulating material layer 16*c* in the z-axis direction as shown in FIG. 2. The end of the via-hole conductor b3 on the negative direction side in the z-axis direction is connected to the downstream end of the line conductor 18*a*. The end of the via-hole conductor b3 on the positive direction side in the z-axis direction is connected to the upstream end of the line conductor 18*b*.

The via-hole conductors b4, b5, and b6 preferably are made of a conductive material, extend through the insulating material layers 16*c*, 16*b*, and 16*a*, respectively, in the z-axis direction, and are connected to each other to define one via-hole conductor, as shown in FIG. 2. The end of the via-hole conductor b4 on the positive direction side in the z-axis direction is connected to the downstream end of the line conductor 18*b*. The end of the via-hole conductor b6 on the negative direction side in the z-axis direction is connected to the external electrode 14*b*. Thus, the via-hole conductor b6 defines an end portion of the main line ML.

The connection conductors 20*a*, 20*b*, and 20*c* preferably are made of a conductive material, and are substantially rectangular conductors provided on the front surfaces of the insulating material layers 16*b*, 16*c*, and 16*b*, respectively, as shown in FIG. 2. The connection conductor 20*a* is arranged so as to overlap with the via-hole conductors b1 and b2 when seen from the z-axis direction in a plan view. Thus, when laminating the insulating material layers 16*a* and 16*b*, even if the insulating material layers 16*a* and 16*b* are displaced from each other in the x-axis direction or the y-axis direction such that the via-hole conductors b1 and b2 are not coincident with each other when seen from the z-axis direction in a plan view, the via-hole conductors b1 and b2 are electrically connected to each other through the connection conductor 20*a*. The functions of the connection conductors 20*b* and 20*c* are the same as that of the connection conductor 20*a*, and thus the description thereof is omitted.

As shown in FIG. 2, from the external electrode 14*a* to the external electrode 14*b*, the main line ML extends toward the positive direction side in the z-axis direction while being wound clockwise, and then linearly extends toward the negative direction side in the z-axis direction.

The sub-line SL is provided within the laminate 12, and is connected between the external electrodes 14*c* and 14*d* as shown in FIG. 2. In other words, both ends of the sub-line SL are connected to the external electrodes 14*c* and 14*d*, respectively. As shown in FIG. 2, the sub-line SL preferably includes line conductors 22 (22*a* and 22*b*), connection conductors 24 (24*a* to 24*g*), and via-hole conductors b11 to b20. The line conductors 22*a* and 22*b* preferably are made of a conductive material, are provided on the insulating material layers 16*f* and 16*e*, respectively, and are wound clockwise when seen from the negative direction side in the z-axis direction in a plan view. Hereinafter, when the line conductors 22*a* and 22*b* are seen from the negative direction side in the z-axis direction in a plan view, the ends of the line conductors 22*a* and 22*b* on the upstream side in the clockwise direction are referred to upstream ends, and the ends of the line conductors 22*a* and 22*b* on the downstream side in the clockwise direction are referred to as downstream ends.

The via-hole conductors b11 to b15 preferably are made of a conductive material, extend through the insulating material layers 16*a* to 16*e* in the z-axis direction, respectively, and are connected to each other to define one via-hole conductor, as shown in FIG. 2. The end of the via-hole conductor b11 on the negative direction side in the z-axis direction is connected to the external electrode 14*c*. In other words, the via-hole conductor b11 defines an end portion of the sub-line SL. The end of the via-hole conductor b15 on the positive direction side in the z-axis direction is connected to the upstream end of the line conductor 22*a*.

The via-hole conductor b16 preferably is made of a conductive material, and extends through the insulating material layer 16*e* in the z-axis direction as shown in FIG. 2. The end of the via-hole conductor b16 on the positive direction side in the z-axis direction is connected to the downstream end of the line conductor 22*a*. The end of the via-hole conductor b16 on the negative direction side in the z-axis direction is connected to the upstream end of the line conductor 22*b*.

The via-hole conductors b17, b18, b19, and b20 preferably are made of a conductive material, extend through the insulating material layers 16*d*, 16*c*, 16*b*, and 16*a*, respectively, in the z-axis direction, and are connected to each other to form one via-hole conductor, as shown in FIG. 2. The end of the via-hole conductor b17 on the positive direction side in the z-axis direction is connected to the downstream end of the line conductor 22*b*. The end of the via-hole conductor b20 on the negative direction side in the z-axis direction is connected to the external electrode 14*d*. In other words, the via-hole conductor b20 defines an end portion of the sub-line SL.

The connection conductors 24*a*, 24*b*, 24*c*, 24*d*, 24*e*, 24*f*, and 24*g* preferably are made of a conductive material, and are substantially rectangular conductors provided on the front surfaces of the insulating material layers 16*b*, 16*c*, 16*d*, 16*e*, 16*d*, 16*c*, and 16*b*, respectively, as shown in FIG. 2. The connection conductor 24*a* is arranged so as to overlap with the via-hole conductors b11 and b12 when seen from the z-axis direction in a plan view. Thus, even if the insulating material layers 16 are displaced from each other during lamination such that the via-hole conductors b11 and b12 are not coincident with each other when seen from the z-axis direction in a plan view, the via-hole conductors b11 and b12 are electrically connected to each other through the connection conductor 24*a*. The functions of the connection conductors 24*b* to 24*g* are preferably the same as that of the connection conductor 24*a*, and thus the description thereof is omitted.

As shown in FIG. 2, from the external electrode 14*c* to the external electrode 14*d*, the sub-line SL linearly extends toward the positive direction side in the z-axis direction, and then extends toward the negative direction side in the z-axis direction while being wound clockwise.

In the main line ML and sub-line SL, when seen from the z-axis direction in a plan view, the region surrounded by the main line ML and the region surrounded by the sub-line SL overlap with each other as shown in FIG. 2. Thus, the main line ML and the sub-line SL are magnetically coupled to each other. In addition, in the main line ML and the sub-line SL, when seen from the z-axis direction in a plan view, the line conductors 18 and the line conductors 22 overlap with each other. Further, the via-hole conductors b1 to b6 and the via-hole conductors b11 to b20 extend parallel or substantially parallel to each other. Thus, the main line ML and the sub-line SL are capacitively coupled to each other. According to the above, the main line ML and the sub-line SL are electromagnetically coupled to each other to provide a directional coupler.

The warpage prevention conductor 26 preferably is made of a conductive material, and is a single-layer substantially rectangular conductor provided on the front surface of the insulating material layer 16*g* as shown in FIG. 2. Specifically, the warpage prevention conductor 26 is provided on the front surface of the insulating material layer 16*g* that is provided on the top surface S1 side of the laminate 12 (i.e., on the positive direction side in the z-axis direction) with respect to the insulating material layers 16*a* to 16*c* to which the main line ML is provided and with respect to the insulating material layers 16*a* to 16*f* to which the sub-line SL is provided. When seen from the z-axis direction in a plan view, the warpage prevention conductor 26 overlaps with the external electrodes 14*a* to 14*d*. Further, when seen from the z-axis direction in a plan view, the warpage prevention conductor 26 overlaps with the via-hole conductors b1, b6, b11, and b20, which are connected to the external electrodes 14*a* to 14*d*, respectively. It should be noted that in the electronic component 10 according to the present preferred embodiment, the external electrodes 14*a* to 14*d* protrude from the warpage prevention conductor 26 when seen from the z-axis direction in a plan view.

Further, when seen from the z-axis direction in a plan view, the warpage prevention conductor 26 overlaps with the entire main line ML and the entire sub-line SL.

Moreover, the warpage prevention conductor 26 is not electrically connected to any other conductor within the laminate 12 as shown in FIG. 2.

In the laminate 12, a conductor layer that is not connected to the main line ML and the sub-line SL is not provided on any of the insulating material layers 16*a* to 16*f* that are provided on the bottom surface S2 side (i.e., on the negative direction side in the z-axis direction) with respect to the insulating material layer 16*g* on which the warpage prevention conductor 26 is provided. In other words, a component other than the main line ML, the sub-line SL, and the external electrodes 14 is not provided on any of the insulating material layer 16*a* to 16*f*.

In the electronic component 10, it is preferable that the external electrode 14*a* is used as an input port, the external electrode 14*b* is used as a main output port, the external electrode 14*c* is used as a monitor output port, and the external electrode 14*d* is used as a 50Ω terminal port. When a signal is inputted to the external electrode 14*a*, the signal is outputted from the external electrode 14*b*, and the signal is also outputted from the external electrode 14*c*.

Next, a method for manufacturing the electronic component 10 will be described with reference to FIGS. 1 and 2.

First, ceramic green sheets that are to be the insulating material layers 16 are prepared. Next, the via-hole conductors b1 to b6 and b11 to b20 are formed on the ceramic green sheets that are to be the insulating material layers 16, respectively. When forming the via-hole conductors b1 to b6 and b11 to b20, a laser beam is radiated to the ceramic green sheets that are to be the insulating material layers 16, to form via holes. Next, the via holes are filled with a conductive paste of Ag, Pd, Cu, Au, or an alloy thereof by a method such as printing application, for example.

Next, a conductive paste including, for example, Ag, Pd, Cu, Au, or an alloy thereof as a principal component is applied by a method such as screen printing or photolithography to the front surfaces of the ceramic green sheets that are to be the insulating material layers 16*a* to 16*g*, to form the external electrodes 14, the line conductors 18 and 22, the connection conductors 20 and 24, and the warpage prevention conductor 26. It should be noted that when forming the external electrodes 14, the line conductors 18 and 22, and the connection conductors 20 and 24, the via holes may be filled with the conductive paste.

Next, each ceramic green sheet is laminated. Specifically, the ceramic green sheets that are to be the insulating material layers 16*a* to 16*h* are individually laminated and pressure-bonded so as to be aligned in order from the negative direction side to the positive direction side in the z-axis direction. By the above processes, a mother laminate is formed. The mother laminate is subjected to main pressure bonding by a hydrostatic press or the like.

Next, the direction identification mark 15 is formed on the top surface S1 of the mother laminate by a method such as transferring.

Next, the mother laminate is cut with a cutting blade to obtain a laminate 12 having a predetermined dimension. Then, the unfired laminate 12 is subjected to de-binder treatment and firing.

By the above processes, a fired laminate 12 is obtained. The laminate 12 is subjected to barrel polishing to perform chamfering.

Finally, Ni plating/Sn plating is applied to the front surfaces of the external electrodes 14. Through the above processes, the electronic component 10 shown in FIG. 1 is completed.

In the electronic component 10 formed as described above, occurrence of warpage in the laminate 12 is reliably prevented. Specifically, in the electronic component 10, the warpage prevention conductor 26 is provided on the front surface of the insulating material layer 16*g* that is provided on the top surface S1 side of the laminate 12 with respect to the insulating material layers 16*a* to 16*c* to which the main line ML is provided and with respect to the insulating material layers 16*a* to 16*f* to which the sub-line SL is provided. In other words, the warpage prevention conductor 26 is provided near the top surface S1 of the laminate 12. Thus, the contraction ratio of the top surface S1 of the laminate 12 is close to the contraction ratio of the bottom surface S2 of the laminate 12. Therefore, occurrence of warpage in the laminate 12 is prevented.

Further, in the electronic component 10, the difference between the contraction ratio of the region of the top surface S1 that overlaps with the external electrodes 14 when seen from the z-axis direction in a plan view and the contraction ratio of the region of the bottom surface S2 where the external electrodes 14 are provided is great. Thus, in the electronic component 10, the warpage prevention conductor 26 overlaps with the external electrodes 14*a* to 14*d* when seen from the z-axis direction in a plan view. Therefore, the difference between the contraction ratio of the region of the top surface S1 that overlaps with the external electrodes 14 when seen from z-axis direction in a plan view and the contraction ratio of the region of the bottom surface S2 where the external electrodes 14 are provided is small. As a result, occurrence of warpage in the laminate 12 is prevented.

Further, in the electronic component 10, if a conductor layer is provided near the bottom surface S2 of the laminate 12, the difference between the contraction ratio of the bottom surface S2 of the laminate 12 and the contraction ratio of the top surface S1 of the laminate 12 is great, and hence causes occurrence of warpage in the laminate 12. Therefore, in the electronic component 10, a conductor layer that is not connected to the main line ML and the sub-line SL is not provided on any of the insulating material layers 16*a* and 16*f* that are provided on the bottom surface S2 side with respect to the insulating material layer 16*g* on which the warpage prevention conductor 26 is provided. In other words, a conductor layer other than the main line ML, the sub-line SL, and the external electrodes 14 is not provided near the bottom surface S2 of the laminate 12. Thus, the contraction ratio of the top surface S1 of the laminate 12 is close to the contraction ratio of the bottom surface S2 of the laminate 12. Therefore, occurrence of warpage in the laminate 12 during firing of the laminate 12 is prevented.

Further, in the electronic component 10, when seen from the z-axis direction in a plan view, the warpage prevention conductor 26 overlaps with the via-hole conductors b1, b6, b11, and b20, which are connected to the external electrodes 14*a* to 14*d*, respectively. Thus, the contraction ratio of the top surface S1 of the laminate 12 is close to the contraction ratio of the bottom surface S2 of the laminate 12. Therefore, occurrence of warpage in the laminate 12 during firing of the laminate 12 is prevented.

The inventors of the present application produced an electronic component 10 in which the warpage prevention conductor 26 is provided (hereinafter, referred to as first sample) and an electronic component in which the warpage prevention conductor 26 is not provided (hereinafter, referred to as second sample), and measured warpage that occurred in the first sample and the second sample.

The dimension of each portion of the first sample and the second sample will be described. As shown in FIG. 1, in each of the first sample and the second sample, the width W in the x-axis direction is set to about 450 μm, the length L in the y-axis direction is set to about 600 μm, and the height in the z-axis direction is set to about 250 μm, for example. In addition, as shown in FIG. 2, in each of the first sample and the second sample, the width D1 of each external electrode 14 in the x-axis direction is set to about 175 μm, and the length D2 thereof in the y-axis direction is set to about 250 μm. Further, in the first sample, the interval D3 between the outer edge of the warpage prevention conductor 26 and the outer edge of the insulating material layer 16*g* is set to about 75 μm, for example. It should be noted that in FIG. 1, the interval between the outer edge of the warpage prevention conductor 26 and the outer edge of the insulating material layer 16*g* is non-uniform, but in the first sample, the interval between the outer edge of the warpage prevention conductor 26 and the outer edge of the insulating material layer 16*g* is uniform.

According to this experiment, no warpage occurred in the first sample, but a warpage having a size of about 17 μm occurred in the second sample. The warpage having a size of about 17 μm means that the distance between the uppermost portion and the lowermost portion of a main surface is about 17 μm. Thus, the above experiments prove that the electronic component 10 prevents occurrence of warpage in the laminate 12.

Further, in the electronic component 10, the external electrodes 14 to which the both ends of the main line ML and the both ends of the sub-line SL are connected are provided on the bottom surface S2 of the laminate 12, and further, the both ends of the main line ML and the both ends of the sub-line SL are formed by the via-hole conductors b1, b6, b11, and b20. In other words, the main line ML and the sub-line SL are not drawn to any side surface of the laminate 12. Thus, in the laminate 12, drawing conductors for drawing the main line ML and the sub-line SL to a side surface of the laminate 12 are not needed, and thus regions for providing the drawing conductors are also not needed on the insulating material layers 16. As a result, the electronic component 10 is reduced in size.

Further, in the electronic component 10, the warpage prevention conductor 26 overlaps with the entire main line ML and the entire sub-line SL when seen from the z-axis direction in a plan view. Thus, noise emitted from the main line ML and the sub-line SL can be prevented from leaking out of the electronic component 10, and noise from the outside of the electronic component 10 is prevented from entering the main line ML and the sub-line SL.

Further, in the electronic component 10, the single-layer substantially rectangular warpage prevention conductor 26 overlaps with the external electrodes 14. Thus, the warpage prevention conductor 26 covers a wide range within the laminate 12 when seen from the z-axis direction in a plan view. As a result, in the electronic component 10, noise emitted from the main line ML and the sub-line SL can be prevented from leaking out of the electronic component 10, and noise from the outside of the electronic component 10 is prevented from entering the main line ML and the sub-line SL.

It should be noted that the electronic component 10 is not limited to the configuration shown in the preferred embodiments described above, and modifications and changes are possible within the scope of the present invention. For example, the warpage prevention conductor 26 is preferably provided as a single layer, but a plurality of warpage prevention conductors 26 may be provided as a plurality of layers on the front surfaces of a plurality of insulating material layers 16. Alternatively, a plurality of warpage prevention conductors 26 may be provided on the front surface of one insulating material layer 16.

Further, in the electronic component 10, the warpage prevention conductor 26 is preferably provided in the laminate 12, but may be exposed from the laminate 12 to the outside. In other words, the warpage prevention conductor 26 may be provided on the top surface S1 of the laminate 12. By so doing, the warpage prevention conductor 26 can be used as a direction identification mark. When the warpage prevention conductor 26 is used as a direction identification mark, it is preferred to provide a cut, a hole, or the like to the warpage prevention conductor 26, so that the warpage prevention conductor 26 has a directional property.

Further, in the electronic component 10, a portion of each external electrode preferably protrudes from the warpage prevention conductor 26 when seen from the z-axis direction in a plan view. However, the entirety of each external electrode 14 may overlap with the warpage prevention conductor 26 when seen from the z-axis direction in a plan view.

As described above, preferred embodiments of the present invention are useful for electronic components, and are excellent particularly in being able to prevent occurrence of warpage in the laminate.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An electronic component comprising:

a laminate including a plurality of laminated insulating material layers;

a main line provided within the laminate;

a sub-line provided within the laminate and electromagnetically coupled to the main line to define a directional coupler;

first and second external electrodes provided on a bottom surface of the laminate and connected to both ends of the main line, respectively;

third and fourth external electrodes provided on the bottom surface of the laminate and connected to both ends of the sub-line, respectively; and a warpage prevention conductor provided on one of the plurality of insulating material layers that is located on a top surface side of the laminate with respect to one of the plurality of insulating material layers on which the main line is provided and with respect to one of the plurality of insulating material layers on which the sub-line is provided, the warpage prevention conductor overlapping with the first to fourth external electrodes when seen from a lamination direction in a plan view; wherein a conductor layer that is not connected to any of the main line and the sub-line is not provided on one of the plurality of insulating material layers provided on a bottom surface side of the laminate with respect to the one of the plurality of insulating material layers on which the warpage prevention conductor is provided; and the warpage prevention conductor is not electrically connected to any other conductor within the laminate.

2. The electronic component according to claim 1, wherein the warpage prevention conductor overlaps with the main line and the sub-line when seen from the lamination direction in the plan view.

3. The electronic component according to claim 1, wherein the warpage prevention conductor is a substantially rectangular conductor that overlaps with the first to fourth external electrodes when seen from the lamination direction in the plan view.

4. The electronic component according to claim 1, wherein each of the main line and the sub-line includes a line conductor provided on the respective one of the plurality of insulating material layers and a via-hole conductor extending through the respective one of the plurality of insulating material layers in the lamination direction; and both ends of the main line and both ends of the sub-line are connected to the external electrodes through the via-hole conductors.

5. The electronic component according to claim 1, wherein the warpage prevention conductor is provided on a top surface of the laminate.

* * * * *